US005729833A

United States Patent [19]

Judge

[11] Patent Number: 5,729,833

[45] Date of Patent: Mar. 24, 1998

[54] CAP HAVING A TACTILE AND VISUAL EMBLEM

[75] Inventor: Matthew J. Judge, Cazenovia, N.Y.

[73] Assignee: The Rockport Company, Inc., Marlboro, Mass.

[21] Appl. No.: 617,410

[22] Filed: Mar. 18, 1996

[51] Int. Cl.[6] ..... A42B 1/24

[52] U.S. Cl. ..... 2/195.1; 2/209.13; 40/329

[58] Field of Search ..... 2/175.1, 195.1, 2/209.13, 10; 40/329; D2/866, 872, 873, 876, 879, 882, 886, 891, 893, 895

[56] References Cited

U.S. PATENT DOCUMENTS

| | | | |
|---|---|---|---|
| 1,538,847 | 5/1925 | Wheeler | 40/329 |
| 2,648,847 | 8/1953 | Crowder | 40/329 |
| 5,233,703 | 8/1993 | Galka | 2/209.13 |
| 5,253,368 | 10/1993 | Blake | 2/209.13 |
| 5,542,127 | 8/1996 | Bezanis | 2/172 |
| 5,556,135 | 9/1996 | Duncan | 2/209.13 |

OTHER PUBLICATIONS

Public use of a hat having the word "Titleist"on the underside of the brim. This hat is believed to have been used by Jesper Parnevik to advertise Titleist while playing golf on the PGA Tour. Mr. Parnevik wore the brim of the hat turned up so that the Titleist name was visible. Applicant is unsure as to a date of first public use of this hat.

*Primary Examiner*—Diana Biefeld

*Attorney, Agent, or Firm*—Sterne, Kessler, Goldstein & Fox, PLLC

[57] ABSTRACT

A cap having a tactile and visual identifier of the source of the cap. The cap includes a crown portion and a brim. The brim has a topside and an underside. An emblem is placed on the underside of the brim. In one embodiment, the emblem is embroidered onto the brim to produce a design which is raised from the surface of the brim. When a wearer dons, removes or adjusts the cap, the wearer's thumb naturally comes into contact with the raised emblem. The tactile feel of the emblem serves to identify to the user the emblem on the cap. Further, the emblem provides a constant visual indication to the wearer of the emblem on the cap.

16 Claims, 2 Drawing Sheets

CAP HAVING A TACTILE AND VISUAL EMBLEM

BACKGROUND OF THE INVENTION

1. Field of the Intention

The present invention relates to a cap having a tactile and visual emblem. In particular, the present invention relates to an emblem located on the underside of a visor of the cap to provide a tactile and visual identifier of the emblem to the wearer.

2. Related Art

Hats and particularly baseball caps are frequently used to market products and/or advertise a company logo, trademark or tradename. Marketers are always looking for ways to improve consumer recognition of a company's products, including recognition of the logo or trademark of the company. Placing these indicia on hats is often a good way to expose a wide variety of consumers to a product.

Cap manufacturers often place emblems on the front of the cap. These emblems may be the cap maker's logo, trademark, tradename, symbol, insignia, or other design. Because the emblem is generally placed on the front of the cap, it is typically viewed only by person's other than the wearer. Further, the placement of the emblem often prevents the wearer from touching the emblem. Once the wearer dons the cap, he or she can no longer see or feel the emblem to identify which cap they are wearing or identify the source of the cap.

SUMMARY OF THE INVENTION

The present invention provides a simple and easy way for the wearer of a cap to identify through tactile and visual senses the emblem on the cap during use. An emblem, often identifying the source of the cap, is placed on the underside of the visor. For ease of reference, the term "emblem" is used herein to refer to a logo, trademark, tradename, symbol, insignia or other design. The emblem is strategically located so that when a wearer dons, removes or adjusts the cap, the wearer's thumb naturally comes into contact with the emblem.

The emblem is often affixed onto the visor to provide a design which is raised from the surface of the visor. Further, because the emblem is approximately the size of an average thumbprint, the entire design of the emblem comes into contact with the wearer's thumb. Thus, the tactile feel of the emblem on the wearer's thumb will serve as an identifier of the emblem on the cap and will reinforce the appearance of the emblem in the mind of the wearer.

In addition to the tactile feel of the emblem, the emblem can also be seen by the wearer while the wearer is wearing the cap. Thus, the emblem also serves as a visual identifier of the emblem on the cap. The wearer is constantly reminded of the emblem on the cap. Thus, the present invention maximizes the marketing potential of a manufacturer's emblem by providing the wearer a tactile and visual identifier of the emblem on the cap.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENT

Figure 1:
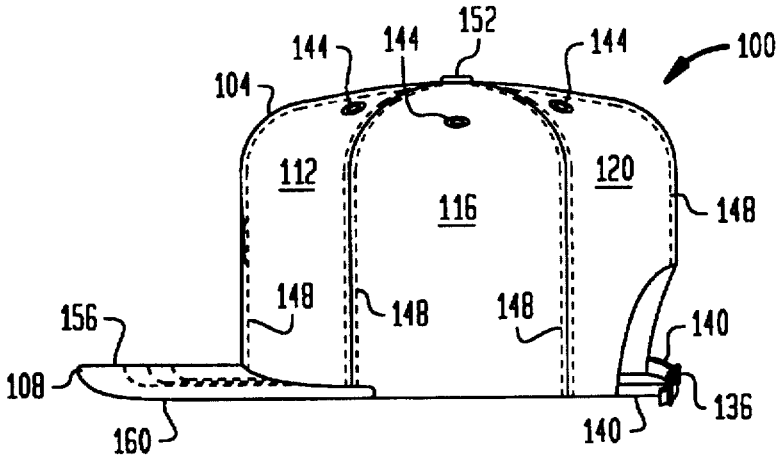
FIG. 1 is a side elevational view of a cap of the present invention.
Figure 2:
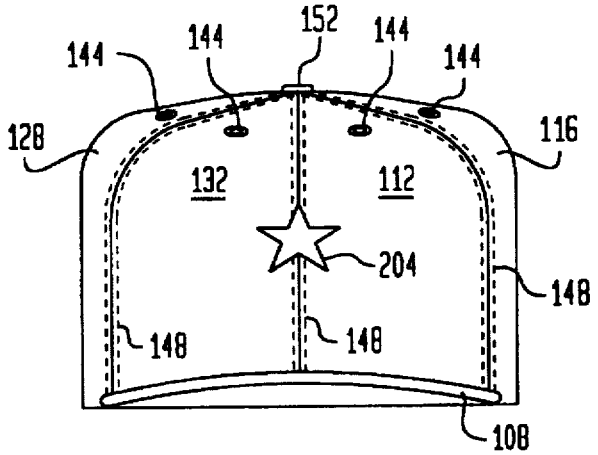
FIG. 2 is a front elevational view of the cap in FIG. 1 having an emblem on the front of the cap.
Figure 3:
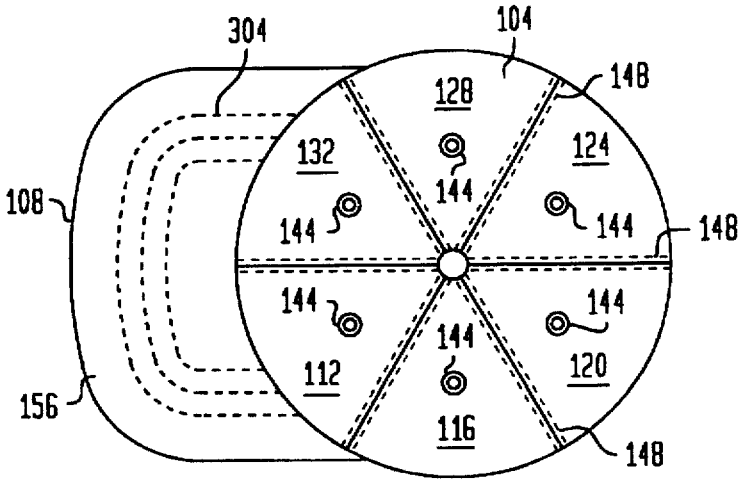
FIG. 3 is a top plan view of the cap in FIG. 1.

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Referring to FIGS. 1–4, a cap 100 having a crown portion 104 and a visor 108 is shown. Visor 108 has a topside 156 and an underside 160. Crown portion 104 is formed from a plurality of gores 112, 116, 120, 124, 128 and 132. Each gore 112–132 is a tapering, often triangular, piece of cloth used to form crown portion 104. In one embodiment, front gores 112 and 132 are stiffened with a mesh layer 420 in order to stand substantially erect during wear. Seams 148 connect gores 112–132 to form crown portion 104. A button 152 at the top center of crown portion 104 secures seams 148 together.

Crown portion 104 has a perimeter 404. A band 408 is secured around substantially all of perimeter 404 of crown portion 104. Band 408 is often made of an absorbent material so that perspiration from the wearer's head is wicked away by the band. Band 408 also provides a soft, comfortable fit about the wearer's head.

A size adjustment device 136 is attached to two straps 140 in the rear of crown portion 104. In one embodiment, straps 140 are made from leather, and size adjustment device 136 is a buckle. Size adjustment device 136 can also be made from a hook and pile closure, or a button, clasp, or snap closure, such as is found on conventional baseball caps. Similarly, straps 140 could be made from nylon or any other sturdy, wear resistant material.

Cap 100 also has ventilation holes 144 located circumferentially about the top of crown portion 104. Ventilation holes 144 allow heat to escape from beneath cap 100 so that the wearer's head does not become overheated.

In one embodiment, a first emblem 204 is located on the exterior of the front of crown portion 104. However, more conservative companies may choose not to place an emblem on the front of crown portion 104. In this case, the manufacturer may choose to discreetly place an emblem on underside 160 of visor 108.

Figure 4:
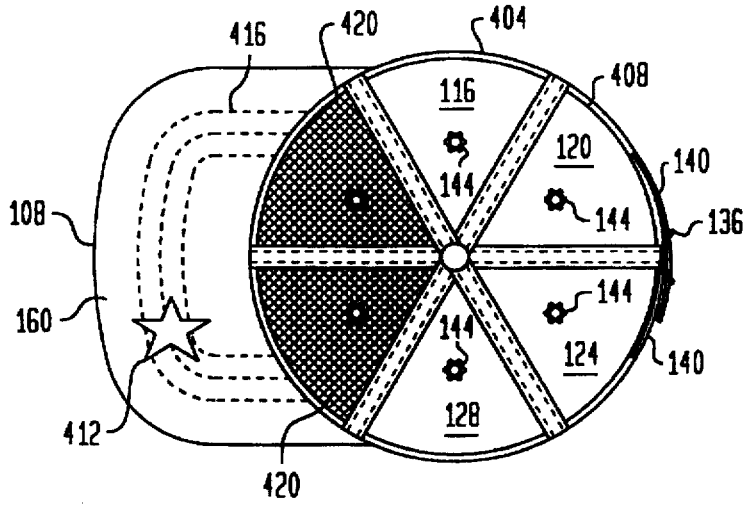
FIG. 4 is a bottom plan view of the cap in FIG. 1 having an emblem on the underside of a visor on the cap.

In the present invention, a second emblem 412 is located on underside 160 of visor 108. In FIG. 4, second emblem 412 is shown to match first emblem 204. However, in an alternate embodiment, the two emblems could be of different designs.

Second emblem 412 presents a design which is raised from underside 160 of visor 108. In one embodiment, second emblem 412 is embroidered directly onto visor 108. Second emblem 412 could also be on a patch or applique which is stitched or otherwise secured to visor 108, or it could be screen printed onto visor 108, or affixed to brim 108 by any other conventional method used to affix emblems to fabric. When a wearer dons, removes or adjusts cap 100, the wearer's thumb will naturally come in contact with second emblem 412. In one embodiment, the emblem is approximately the size of an average thumbprint so that the wearer's thumb comes into contact with the entire emblem. This contact provides a tactile identifier for the wearer of the emblem, which identifies, in some instances, the source of the cap and/or the design displayed on the front of the cap. Further, second emblem 412 provides a visual identifier of the source of the cap and/or the design displayed on the front of the cap.

Topside 156 of visor 108 has stitching 304. In the preferred embodiment, the color of stitching 304 matches the color of visor 108. However, stitching 304 can be any color. Underside 160 of visor 108 has stitching 416. In the preferred embodiment, stitching 416 is made with a clear thread so that it does not obscure second emblem 412.

One characteristic common to most baseball cap wearers is that when the wearer dons, removes or adjusts their cap, their hand instinctively touches the same portion of the visor of the cap. For a right-handed wearer, the wearer's thumb typically touches the underside of the visor at approximately a 45° angle to the right of the center of the visor. For a left-handed wearer, the wearer's thumb typically touches the underside of the visor at approximately a 45° angle to the left of the center of the visor. Similarly, the wearer's index finger touches the top of the visor at approximately the same location.

Figure 5:
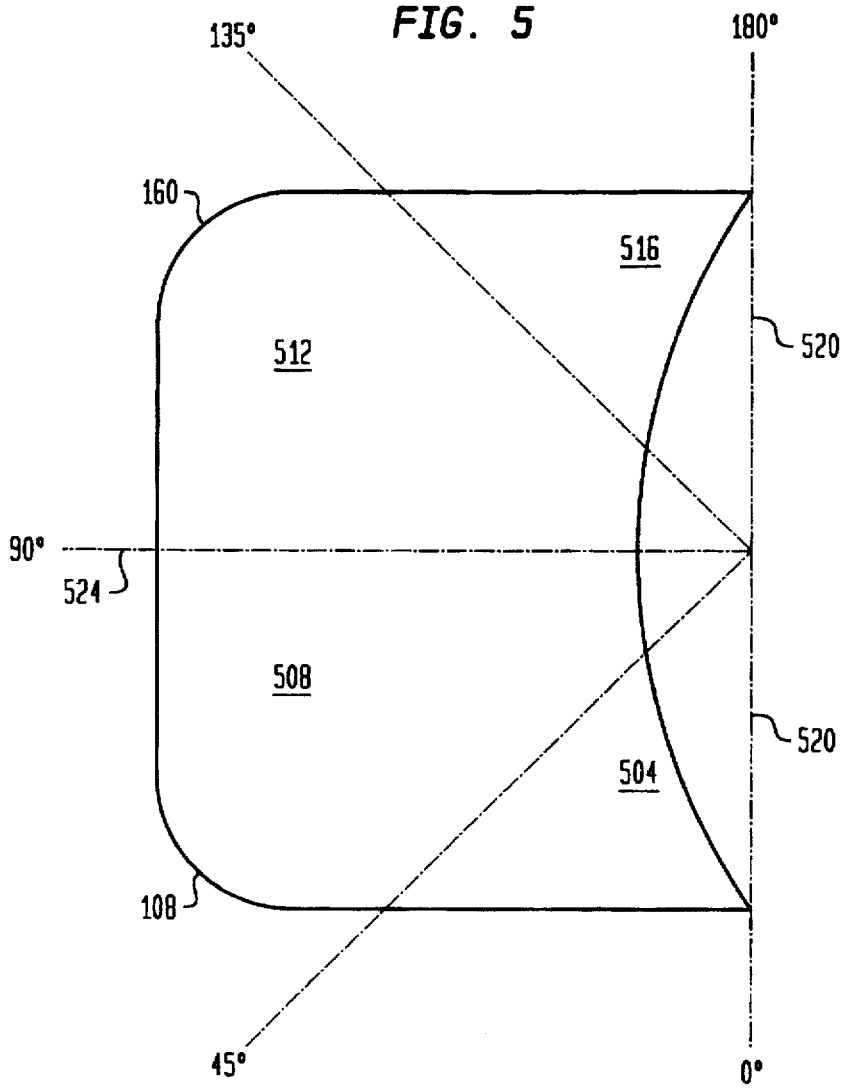
FIG. 5 is a bottom view of the visor of the cap of FIG. 1.

FIG. 5 shows underside 160 of visor 108 divided into quadrants 504, 508, 512 and 516. A baseline 520 is designated at 0° to the left of center and at 180° to the right of center. A center line 524 is designated at 90°. Quadrant 504 is located between 0° and 45° on visor 108. Quadrant 508 is located between 45° and 90° on visor 108. Quadrant 512 is located between 90° and 135°, and quadrant 516 is located between 135° and 180° on visor 108. Caps made for a right-handed wearer have an emblem located in quadrant 508. Similarly, caps made for a left-handed wearer have an emblem located in quadrant 512. In one embodiment, the entire emblem is located only in quadrant 508 (for right-handed wearers) or quadrant 512 (for left-handed wearers). No part of the emblem extends beyond the quadrant. Further, in this embodiment, the emblem in the quadrant is the only design present on underside 160 of visor 108.

To further maximize the marketing potential of a manufacturer's logo, trademark or tradename, the emblem could be affixed on topside 156 of visor 108 (not shown) in quadrants 508 and 512, as identified above, so that the wearer's index finger naturally rests on the emblem when the wearer is donning, removing or adjusting cap 100.

While the invention has been particularly shown and described with reference to preferred embodiments thereof, it will be understood by those skilled in the art that various changes in form and details may be made therein without departing from the spirit and scope of the invention.

What is claimed is:

1. A cap, comprising:

a crown portion having a front side;

a visor secured to and projection outwardly and perpendicularly from said front side of said crown portion, said visor having a topside and an underside; and a tactile emblem located on the underside of said visor, wherein said visor has a baseline at the intersection of said visor and said crown portion, said visor having a first quadrant located between an angle of 45 to 90 degrees as measured from said baseline, and a second quadrant located between an angle of 90 to 135 degrees as measured from said baseline, said tactile emblem being located on said visor in one of said first quadrant and said second quadrant, and wherein the remainder of said underside of said visor is without an emblem.

2. The cap of claim 1, wherein said tactile emblem is selected from the group consisting of a logo, trademark, tradename, symbol, insignia and design.

3. The cap of claim 1, wherein said tactile emblem is embroidered on said visor.

4. The cap of claim 1, wherein said tactile emblem is on a patch which is affixed to said visor.

5. The cap of claim 4, wherein said patch is affixed to said visor by sewing.

6. The cap of claim 1, wherein said tactile emblem is screen printed onto said visor.

7. The cap of claim 1, further comprising:

first stitching on the topside of said visor; and second stitching on the underside of said visor.

8. The cap of claim 7, wherein said second stitching is made of a clear thread which does not obscure said tactile emblem.

9. A cap, comprising:

a crown portion having a front side;

a visor secured to and projecting outwardly and perpendicularly from said front side of said crown portion, said visor having a top side and an underside; and a tactile emblem located on the underside of said visor, wherein said tactile emblem is located on said visor such that when a wearer dons, removes or adjusts the cap, the wearer's thumb naturally comes into contact with said tactile emblem, wherein said tactile emblem is the size of a thumbprint, and wherein the remainder of said underside of said visor is without an emblem.

10. The cap of claim 9, wherein said emblem is selected from the group consisting of a logo, trademark, tradename, symbol, insignia and design.

11. The cap of claim 9, wherein said tactile emblem is embroidered on said visor.

12. The cap of claim 9, wherein said tactile emblem is on a patch which is affixed to said visor.

13. The cap of claim 12, wherein said patch is affixed to said visor by sewing.

14. The cap of claim 9, wherein said tactile emblem is screen printed onto said visor.

15. The cap of claim 9, further comprising:

first stitching on the topside of said visor; and second stitching on the underside of said visor.

16. The cap of claim 15, wherein said second stitching is made of a clear thread which does not obscure said tactile emblem.

* * * * *